US005584574A

United States Patent [19]

Haddad

[11] Patent Number: 5,584,574

[45] Date of Patent: Dec. 17, 1996

[54] VERSATILE FLOOD LIGHT

[75] Inventor: Eric Haddad, East Berlin, Pa.

[73] Assignee: HADCO Division of The Genlyte Group Incorporated, Littlestown, Pa.

[21] Appl. No.: 583,465

[22] Filed: Jan. 5, 1996

[51] Int. Cl.[6] ..... F21P 1/00

[52] U.S. Cl. ..... 362/359; 362/361; 362/280; 362/323; 362/442

[58] Field of Search ..... 362/277, 280, 362/282, 311, 319, 322, 323, 359, 360, 361, 293, 325, 307, 442

[56] References Cited

U.S. PATENT DOCUMENTS

| | | | |
|---|---|---|---|
| 1,356,145 | 10/1920 | Hawthrone | 362/280 |
| 1,639,753 | 8/1927 | Shelton | 362/282 |
| 2,075,199 | 3/1937 | Horner | 362/280 |
| 3,610,915 | 10/1971 | Moore . | |
| 3,666,935 | 5/1972 | Pritchett . | |
| 3,711,702 | 1/1973 | Adra . | |
| 3,755,665 | 8/1973 | Grindle . | |
| 3,895,227 | 7/1975 | Murray . | |
| 3,919,542 | 11/1975 | Castic . | |
| 4,164,784 | 8/1979 | Jaksich | 362/282 |
| 4,288,846 | 9/1981 | Fletcher | 362/217 |
| 4,323,953 | 4/1982 | Hutchison | 362/226 |
| 4,519,018 | 5/1985 | Rowland | 362/280 |
| 4,695,930 | 9/1987 | Wierzbicki | 362/293 |
| 4,709,312 | 11/1987 | Heinisch | 362/298 |
| 4,760,499 | 7/1988 | IL | 362/282 |
| 5,086,379 | 2/1992 | Denison | 362/145 |
| 5,158,348 | 10/1992 | Sakamoto | 362/19 |

*Primary Examiner*—Ira S. Lazarus
*Assistant Examiner*—Thomas M. Sember
*Attorney, Agent, or Firm*—Hopgood, Calimafde, Kalil & Judlowe

[57] ABSTRACT

Described is an adjustable flood light fixture suitable for outdoor use which can adjustably cut-off unwanted glare through the use of a truncated cone shroud which can be rotated 360°.

4 Claims, 4 Drawing Sheets

VERSATILE FLOOD LIGHT

BACKGROUND OF THE INVENTION

1. Field of Invention

The present disclosure describes an adjustable flood light fixture suitable for outdoor use. More particularly, the invention is directed to a novel housing having a slanted shroud which is 360° rotatable, and an adjustable lamp support for optional inserts, for versatile aiming of illumination on a target while maintaining the ability to reduce and adjust against unwanted glare.

2. Description of the Related Art

Outdoor flood lights are known such as disclosed in U.S. Pat. Nos. 3,610,915, 3,919,542, 4,164,784, 4,709,312, 5,086,379 and 5,158,348. U.S. Pat. No. 3,711,702 describes a floodlight having an outer cowling and a front lens cover which could form a weatherproof seal. U.S. Pat. No. 3,895,227 describes a floodlight having an optical assembly connected via a casing to a weatherproof ballast assembly. These patents are typical of the art which feature attempts at tight, waterproof seals with no real emphasis on aiming or adjustment for the flood light to avoid glare.

When conventional floodlights are aimed at a target to be illuminated, glare is often present when a person looks towards the source of the light. Fixtures taught by the prior art do not have features for easily adjusting the angle and direction of illumination once the fixture is mounted (usually to the ground) to avoid this unwanted glare.

Glare can also be accentuated by weather residues and debris which often collect on the lens covers of known flood lights such as when precipitation lands on the lens, evaporates with the heat from the lamp and leaves behind cloudy remnants. For example, U.S. Pat. Nos. 4,288,846, 4,323,953 and 4,695,930 describe state-of-the-art flood light fixtures having housing assemblies which are designed for outdoor mounting, but which do not feature any solutions to the problems associated with glare which is accentuated by weather residues and debris. The present invention addresses the problems hereinabove identified.

OBJECTS OF THE INVENTION

Accordingly, it is an object of this invention to provide an improved outdoor flood light fixture having a novel housing incorporating a rotatable, slanted shroud, a slanted lens and breakaway lamp holder fingers for optional inserts such as louvers or filters, all for versatile installation., aiming and adjustment of the flood light to provide light cut-off and glare shield. These and other objects will become apparent in the following description.

SUMMARY OF THE INVENTION

The present invention is an adjustable, outdoor flood light fixture comprising a lamp housing having an optional, slanted shroud which is rotatable 360°. This rotation of the slanted shroud allows glare reducing adjustment of the fixture even after the fixture is aimed and permanently mounted. The slanted, rotatable shroud allows physical adjustment of relatively small increments in light direction for avoiding glaring effects without loss of primary illumination to the intended target.

Additional features include breakaway lamp holder fingers at the ends of the lamp support within the fixture's housing for use of an optional louver or filter. The optional louver provides a glare shield through physical changes in the direction of light emanating from the lamp and passing through the louver. The optional filter, such as one that is colored, cuts glare through changes in wavelength of light emanating from the lamp and passing through it.

A further feature is the use of a slanted cover lens. Dust, moisture and weather debris often collect on cover lenses which are used for protecting lamps against such elements. As explained in the Background, such elements leave behind a cloudy film which detracts from illumination and exacerbates any pre-existing glare problems especially when precipitation evaporates with the heat from the lamp. The use of a slanted lens in the present invention addresses such problems. Moisture quickly runs off the slant carrying with it debris which avoids the residue effects ever-present in known fixtures.

Accordingly, the invention is an adjustable outdoor flood light comprising a housing having an open end and an interior area with a shroud adjustably inserted onto the open end of the housing. The shroud has two ends, with a slanted outer edge on a first end, and at least one threading portion which forms a circumferential trench on the second end of the shroud.

The trench allows for adjustment of the shroud along its 360° circumference to accommodate the glare cut-off. A shroud securing means such as screw is used to secure the shroud on the circumferential trench after adjustment. The cover lens is mounted within the shroud at an angle greater than about a 10° angle from a vertical plane of the open end of the housing allowing for the slant and self-washing capability of the cover lens.

The adjustable outdoor flood light further comprises a plurality of lamp supports in the interior of the housing. These lamp supports each have a breakable finger capable of being cut off for placing an insert between a lamp mounted in the housing and the lens. The insert, as stated above, is usually a louver or a filter for reducing glare. The adjustable outdoor flood light further comprises a plurality of lamp ramps formed on the shroud which automatically center a lamp inserted in the housing.

DETAILED DESCRIPTION OF THE INVENTION

Figure 1:
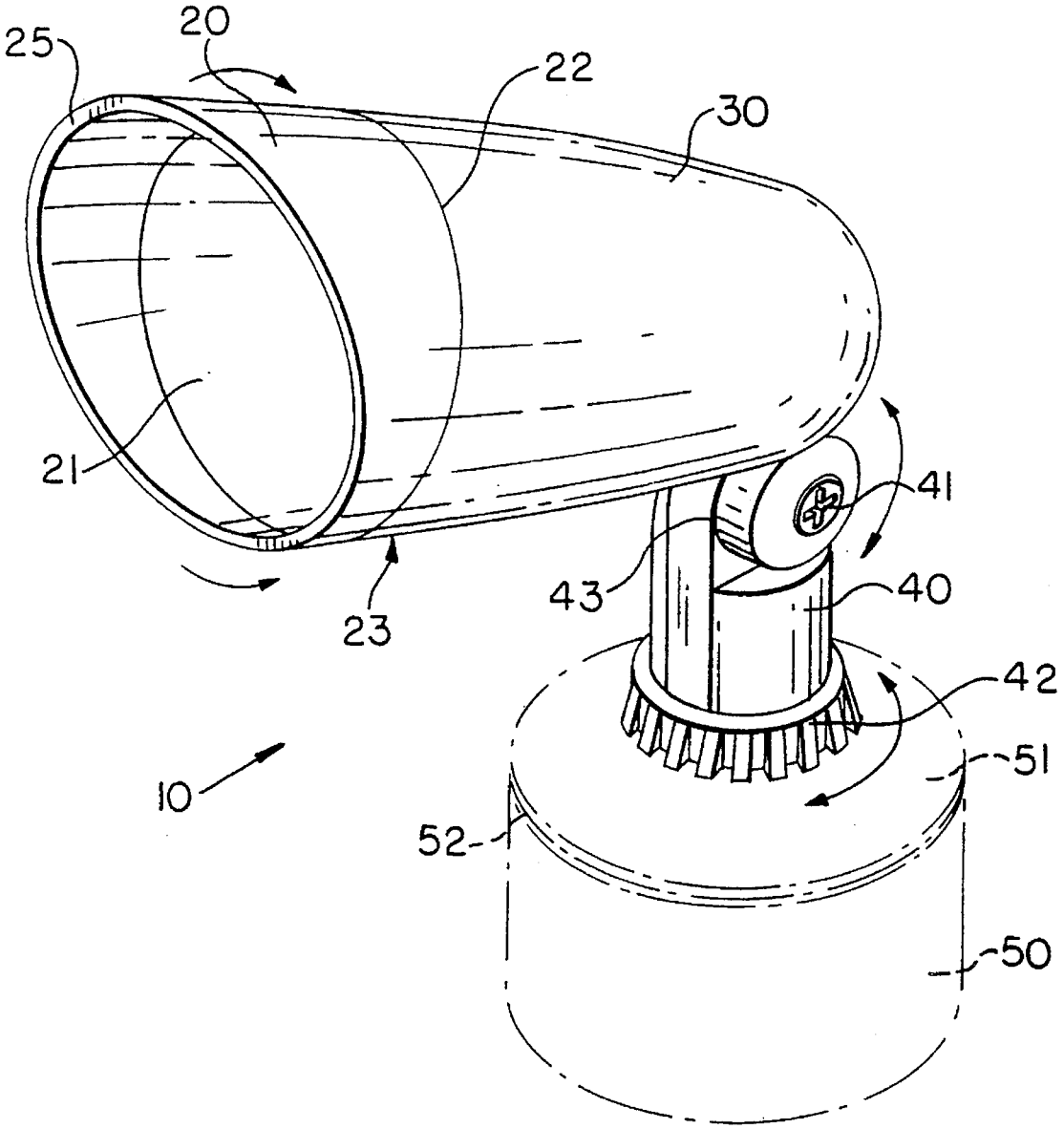
FIG. 1 is a perspective view of the present invention with arrows showing the adjustable features offered by the flood light fixture.

FIG. 1 depicts the adjustable outdoor flood light designated with numeral 10. Flood light 10 is depicted as comprising shroud 20 and housing 30, with arm 40 connecting housing 30 to junction box 50 (shown in phantom lines). Cover lens 21 is mounted within shroud 20, and shroud 20 is inserted, twisted and screwed into housing 30 and sealed via O-ring 22 and held by shroud screw 23.

As depicted in FIG. 1, shroud 20 is a truncated cone having a slanted outer edge 25. Lens 21 is also at a slanted angle from the vertical plane of O-ring 22, preferably greater than about a 10° angle. In the preferred embodiment, substantially all components comprising fixture 10 are made of weather resistant non-metallic material. For example, shroud 20, housing 30, arm 40 and junction box 50 can all be made of a plastic, polyphenylene sulfite (PPS) available under the trade name Ryton™. Such materials are particularly suited for outdoor use, even at high temperatures.

Arm 40 has a swivel connection 41 with O-ring 43 and lock nut 42. Junction box 50 has a cover 51 which are connected via a gasket 52, all depicted in phantom lines.

Figure 2:
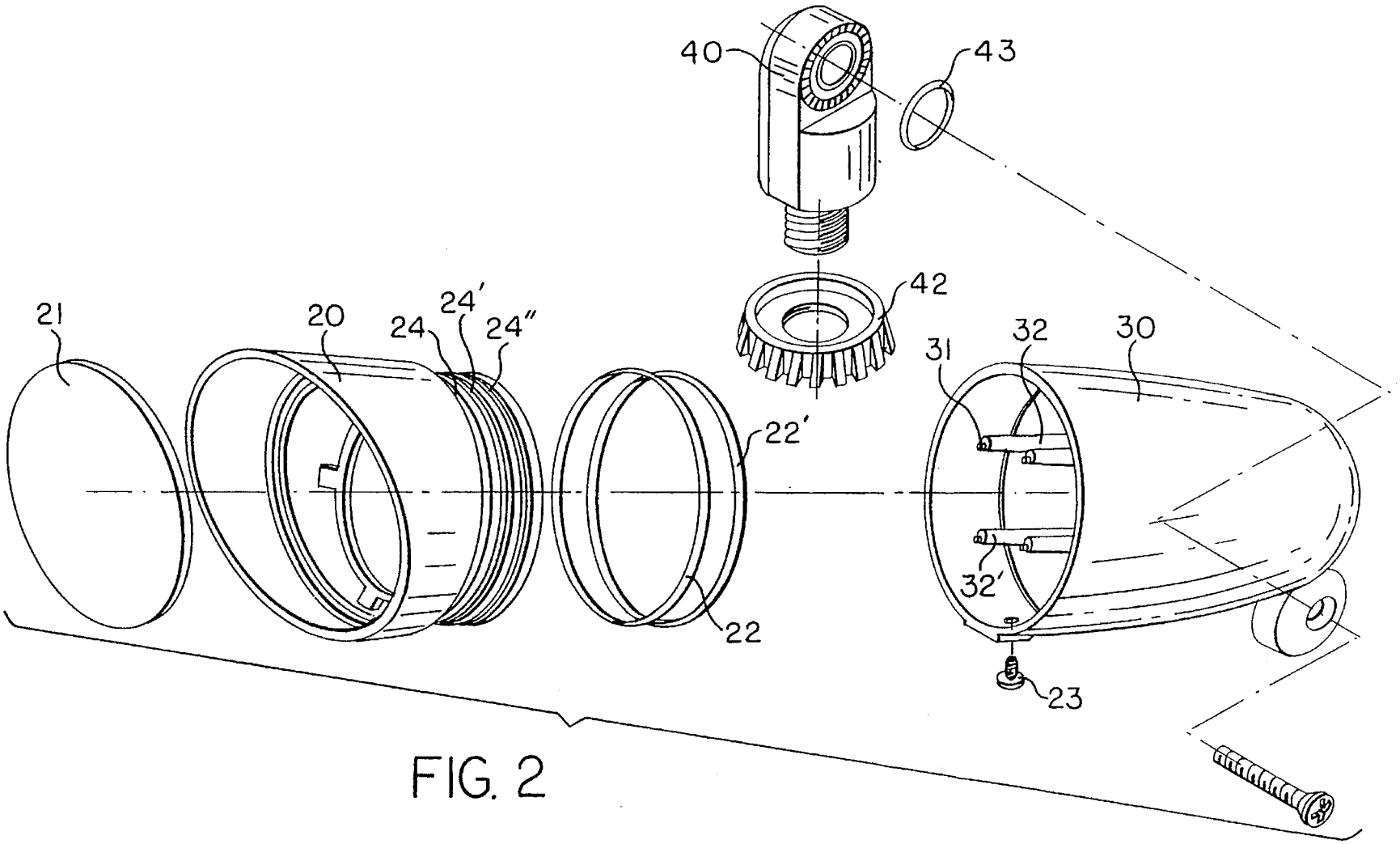
FIG. 2 is an exploded perspective view of the component pieces which comprise the present invention.

FIG. 2 is an exploded perspective view of the component pieces which comprise the preferred embodiment of the present invention. Shroud 20 is shown as having threading portions 24, 24' and 24". Threading portions 24 is designed to engage shroud screw 23 anywhere on its 360° trench circumference. This allows shroud 20 to be rotated 360° in either direction until the desired glare cut-off is achieved. Screw 23 can be tightened after suitable rotatory adjustment of the shroud 20, which is sealed contemporaneously, with O-rings 22 and 22' which seat on circular threading portions 24' and 24", respectively.

Figures 3, 4, 5:
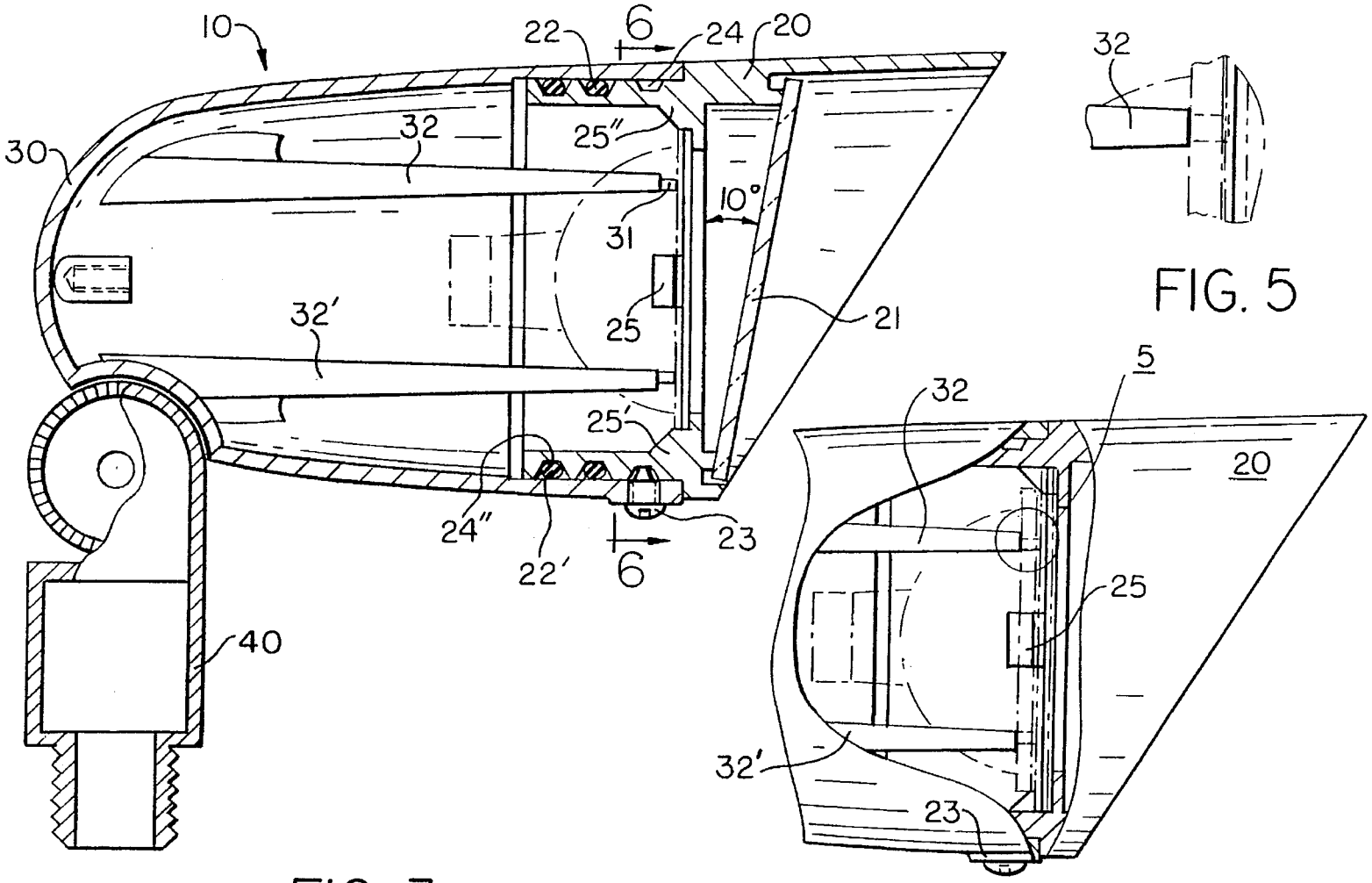
FIG. 3 is a side, cut-away view into the interior of the fixture with a lamp drawn in phantom lines and showing the cross-section of the 360° rotatable shroud and slanted lens cover.
FIGS. 4 and 5 are side, cut-away views into the interior of the fixture with a lamp drawn in phantom lines and showing portions of the optional insert which can be a louver or a colored filter.

FIG. 3 is a side, cut-away view into the interior of fixture 10 with a lamp drawn in phantom lines and showing the cross section of the 360° rotatable shroud 20. Lens 21 is shown mounted into the shroud at about a 10°, slanted angle from the vertical plane of the face of the lamp. This arrangement allows lens 21 to be a self-washing lens, permitting moisture and debris to slide off at substantially all angles in which shroud 20 is aimed.

Figure 6:
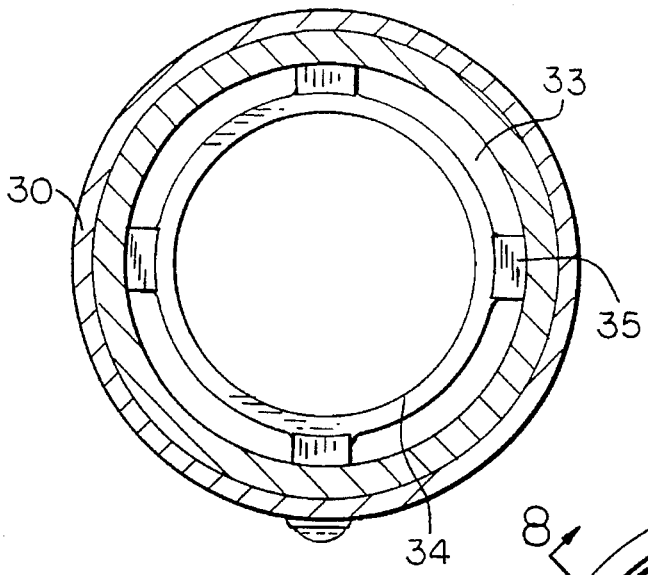
FIG. 6 is a cross-section taken from lines 6—6 in FIG. 3, and shows heat vents.

Shroud 20 has threading portion 24 which is shown engaged to shroud screw 23. Shroud 20 also has threading portion 24" which is shown engaged to O-ring 22'. Also featured on shroud 20 are lamp ramps 25, 25' and 25". Lamp ramps 25, 25' and 25" along with a fourth lamp ramp (not shown) automatically center the lamp for easy installation and replacement. FIG. 6 is a cross-section taken from lines 6—6 in FIG. 3, and shows heat vents 33, center ring 34 and center ring support 35.

FIG. 4 depicts a second embodiment featuring an insert 5 for added glare cut-off. FIG. 4 shows a cut-away view into the interior of the fixture with a lamp drawn in phantom lines and showing portions of lamp supports 32 and 32'. Referring to FIGS. 3 and 4 comparatively, FIG. 3 shows lamp support 32 having a breakable lamp holder finger 31 at its tip, and FIG. 4 shows this tip cut off from the end of lamp support 32.

Figure 7:
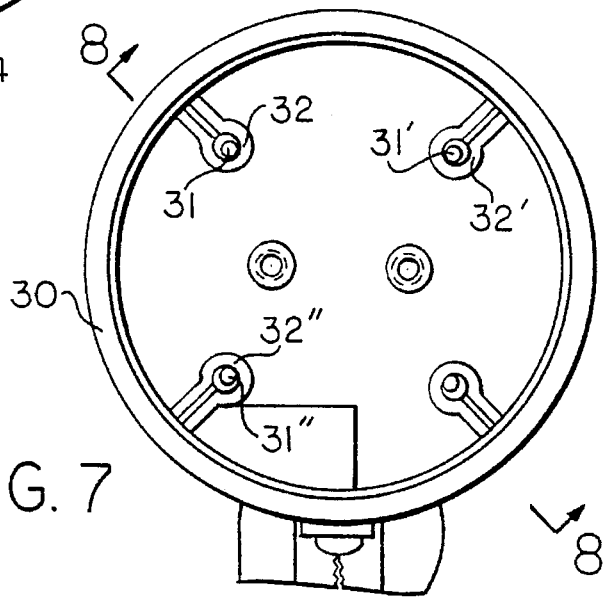
FIG. 7 is a front, end-view of the housing with the shroud removed and prominently displays the breakable lamp holder fingers.
Figure 8:
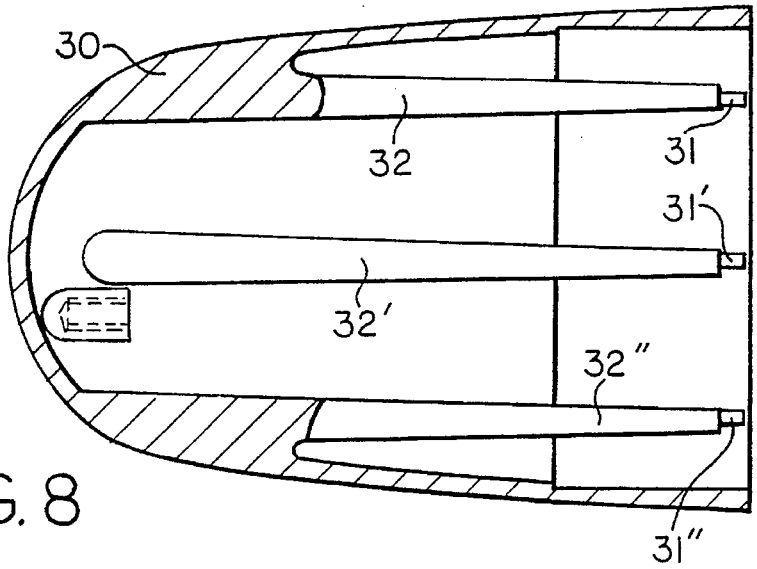
FIG. 8 is a side, cut-away view taken from lines 8—8 in FIG. 7 and shows a side view of three lamp supports having the breakable, lamp holder fingers at their tips.

This is better demonstrated with FIGS. 7 and 8. FIG. 7 shows a front, end-view of housing 30 with the shroud removed and prominently displaying breakable lamp holder fingers 31, 31' and 31" on lamp supports 32, 32' and 32". FIG. 8 is a side, cut-away view taken from lines 8—8 in FIG. 7 and shows a side view of three lamp supports 32, 32' and 32" having breakable, lamp holder fingers 31, 31' and 31". Lamp holder fingers 31, 31' and 31" and the fourth finger (not numbered) are snipped off if an optional insert is desired.

FIG. 5 is a magnified view from FIG. 4 and shows insert 5 flush against lamp support 32. Insert 5 can be an optional "hex" louver which is a flat plate having a plurality of hexagon shaped apertures therethrough. Other louver options are known to those skilled in the art. Insert 5 can also be a transparent or translucent filter. Both the optional louver and filter provide glare shield as well as their other functions such as altering the color of illumination such as with a tinted glass filter.

Various modifications and alterations to the present invention may be appreciated based on a review of this disclosure. These changes and additions are intended to be within the scope and spirit of this invention as defined by the following claims.

What is claimed is:

1. An adjustable outdoor flood light, comprising:

a housing having an open end and an interior;

a shroud inserted onto said open end of said housing, said shroud having a slanted outer edge, and at least one threading portion, said threading portion forming a circumferential trench;

a cover lens mounted within said shroud at an angle greater than about a 10° angle from a vertical plane of said open end of said housing; and a shroud securing means, said shroud securing means for securing said shroud via said at least one threading portion for adjusting said shroud along said trench throughout its 360° circumference.

2. The adjustable outdoor flood light of claim 1, further comprising a plurality of lamp supports in said interior of said housing, said lamp supports each having a breakable finger, said finger capable of being cut off for placing an insert between a lamp mounted in said housing and said lens.

3. The adjustable outdoor flood light of claim 2, wherein said insert is louver or a filter.

4. The adjustable outdoor flood light of claim 1, wherein said shroud further comprises a plurality of lamp ramps for centering a lamp into said interior of said housing.

* * * * *